United States Patent [19]

Shibusawa et al.

[11] Patent Number: 5,077,579

[45] Date of Patent: Dec. 31, 1991

[54] COPIES WITH AUTOMATIC DOCUMENT FEEDER

[75] Inventors: Mitsuo Shibusawa, Yokohama; Yosiharu Hariu, Yamato, both of Japan

[73] Assignee: Rocoh Company, Ltd., Tokyo, Japan

[21] Appl. No.: 372,176

[22] Filed: Jun. 27, 1989

Related U.S. Application Data

[63] Continuation of Ser. No. 235,520, Aug. 24, 1988, abandoned.

[30] Foreign Application Priority Data

Aug. 28, 1987 [JP] Japan ..... 62-216194

[51] Int. Cl.[5] ..... G03G 15/00

[52] U.S. Cl. ..... 355/309; 355/75

[58] Field of Search ..... 355/75, 76, 48, 50, 355/51, 308, 309, 313; 271/291, 301, 902

[56] References Cited

U.S. PATENT DOCUMENTS

| | | | |
|---|---|---|---|
| 4,433,909 | 2/1984 | Goes In Center | 355/75 |
| 4,540,269 | 9/1985 | Nishiyama | 355/75 X |
| 4,579,326 | 4/1986 | Pinckney et al. | 271/291 X |
| 4,674,862 | 6/1987 | Abuyama | 355/14 SH |

*Primary Examiner*—R. L. Moses

*Attorney, Agent, or Firm*—Oblon, Spivak, McClelland, Maier & Neustadt

[57] ABSTRACT

A copier selectively operable in a cover plate mode which uses a cover plate and an automatic document feeder (ADF) mode which uses an ADF. After a cover plate mode operation of the copier, a person is inhibited from operating the copier when a condition wherein the cover plate is closed and documents are loaded on a document feed table of the copier is detected.

6 Claims, 7 Drawing Sheets

| |
|---|
| Fig. 5B-1 |
| Fig. 5B-2 |

COPIES WITH AUTOMATIC DOCUMENT FEEDER

This application is a continuation of application Ser. No. 235,520, filed on Aug. 24, 1988, now abandoned.

BACKGROUND OF THE INVENTION

The present invention relates to a copier selectively operable in a cover plate mode which uses a cover plate and an automatic document feeder (ADF) mode which uses an ADF and, more particularly, to a copier provided with an implementation for preventing an original document left unremoved on a glass platen after an ADF mode operation from being not driven out of the copier to jam the copier and thereby being damaged itself.

A copier is generally operated in one of two different modes: a cover plate mode which uses a cover plate and an ADF mode which uses an ADF, as stated above. Specifically, in the cover plate mode an original document is laid on a glass platen of a copier body and then pressed from above by a cover plate which is openably mounted on the copier body. In the ADF mode which may be selected when a number of original documents are to be reproduced continuously, documents are loaded on a document feed table and then fed one by one by the ADF automatically to between the cover plate and the glass platen, each document undergoing reproduction being driven out of the copier body automatically. These two modes available with a copier promote efficient copying operations.

In the cover plate mode, it often occurs that a document is inadvertently left on the glass platen after it has been copied. When the ADF mode operation is effected without removing such a document, the document is not discharged from the copier to jam the copier and is therefore damaged itself. This kind of trouble has heretofore been coped with by adopting an audible alarm such as a buzzer or voice or a visible alarm such as a display which is provided on an operation board.

A problem with the buzzer or similar audible alarm is that it usually produces low sound for only a short period of time to avoid annoyance and, therefore, a person is apt to start on the next operation without noticing the sound. Even the display on the operation board is often overlooked by another person who may intend to operate the copier in the ADF mode. In any case, the document left on the glass platen would jam the copier without being discharged from the copier body.

SUMMARY OF THE INVENTION

It is therefore an object of the present invention to provide a copier capable of preventing a document which is inadvertently left unremoved on a glass platen at the end of a cover plate mode operation from jamming the copier during an ADF mode operation which may follow the cover plate mode operation.

It is another object of the present invention to provide a generally improved copier with an ADF.

A copier selectively operable in a cover plate mode in which an original document is laid on a glass platen of a body of the copier and cover plate openably mounted on the body is closed to copy the document and an automatic document feeder (ADF) mode in which documents loaded on a document feed table of the copier are fed automatically one by one to between the cover plate being closed and the glass platen of the present invention comprises a cover plate position sensor for sensing an open and a closed position of the cover plate, a document sensor for sensing original documents which are loaded on the document feed table, and a control for controlling the copier such that after a copying operation has been executed in the cover plate mode, any further copying operation is inhibited when the cover plate position sensor senses a closed position of the cover plate and the document sensor senses original documents.

BRIEF DESCRIPTION OF THE DRAWINGS

The above and other objects, features and advantages of the present invention will become more apparent from the following detailed description taken with the accompanying drawings in which:

FIGS. 4A, 4B, 5A, 5B, 5B-1, and 5B-2 are flowcharts demonstrating a specific operation of the control system as shown in FIG. 1.

DESCRIPTION OF THE PREFERRED EMBODIMENT

Figure 1:
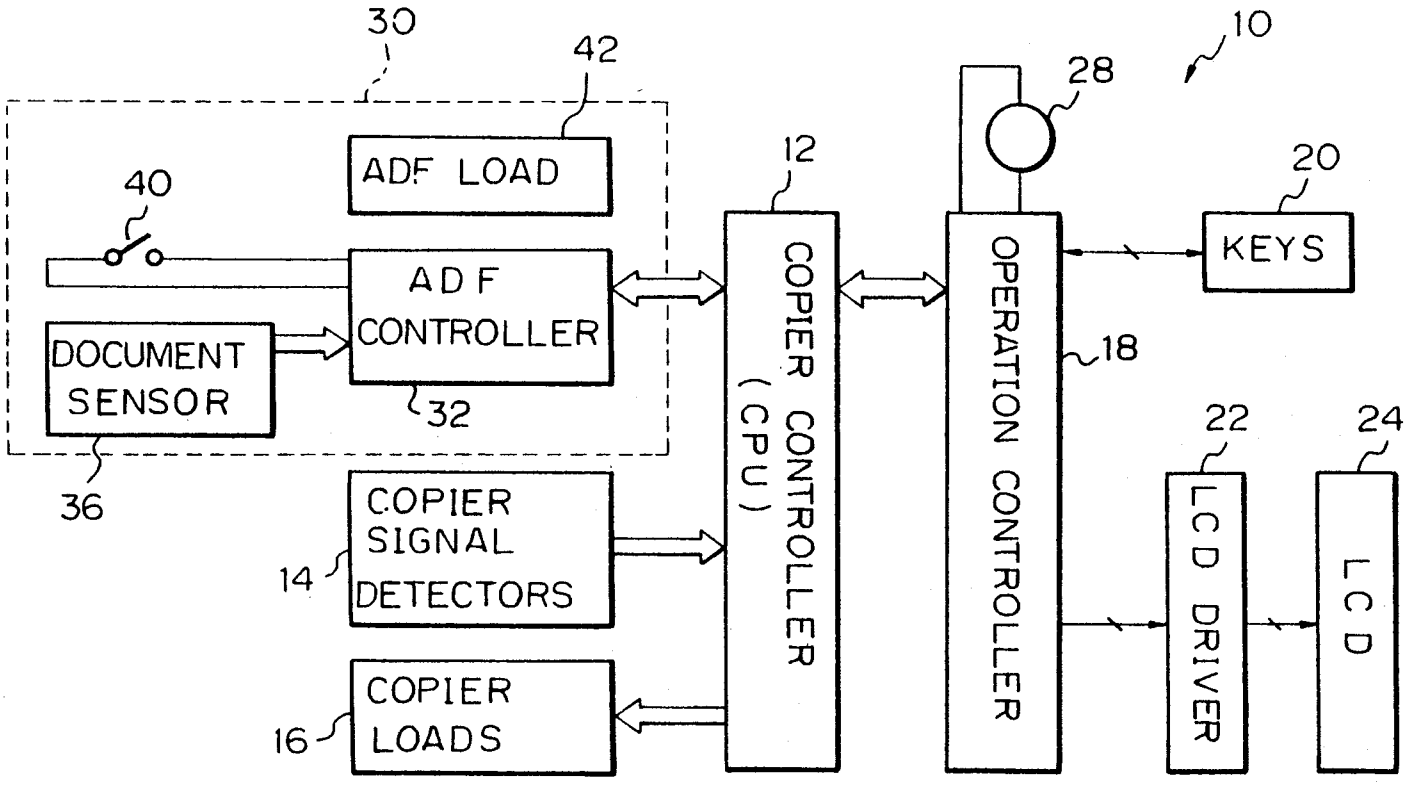
FIG. 1 is a schematic block diagram representative of one embodiment of the copier with an ADF in accordance with the present invention.
Figure 2:
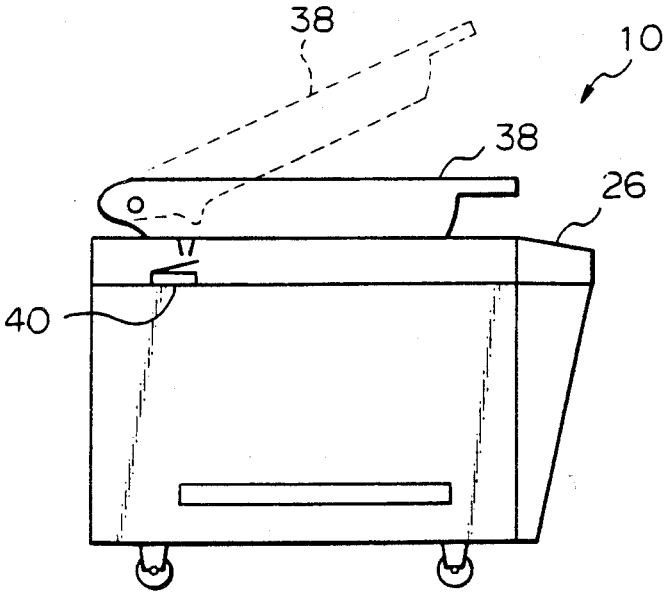
FIG. 2 is a side elevation showing the copier of FIG. 1.

Referring to FIG. 1 of the drawings, a copier embodying the present invention is shown in a schematic block diagram and generally designated by the reference numeral 10. As shown, the copier 10 includes a copier controller 12 which serves as a main control and is chiefly implemented as a central processing unit (CPU). Applied to the copier controller 12 are the outputs of various copier signal detectors 14 which are incorporated in the copier 10. The copier controller 12 delivers drive commands to copier loads 16 which include a motor solenoid and optics. An operation controller 18 is connected to the copier controller 12 while keys 20 are connected to the operation controller 18. A liquid crystal display (LCD) 24 is connected to the operation controller 18 via an LCD driver 22. The keys 20 and LCD 24 are provided on an operation board 26, as shown in FIG. 2. Further connected to the operation controller 18 is a buzzer 28 which alerts a person to a document which is left unremoved on a glass platen (no numeral).

Figure 3:
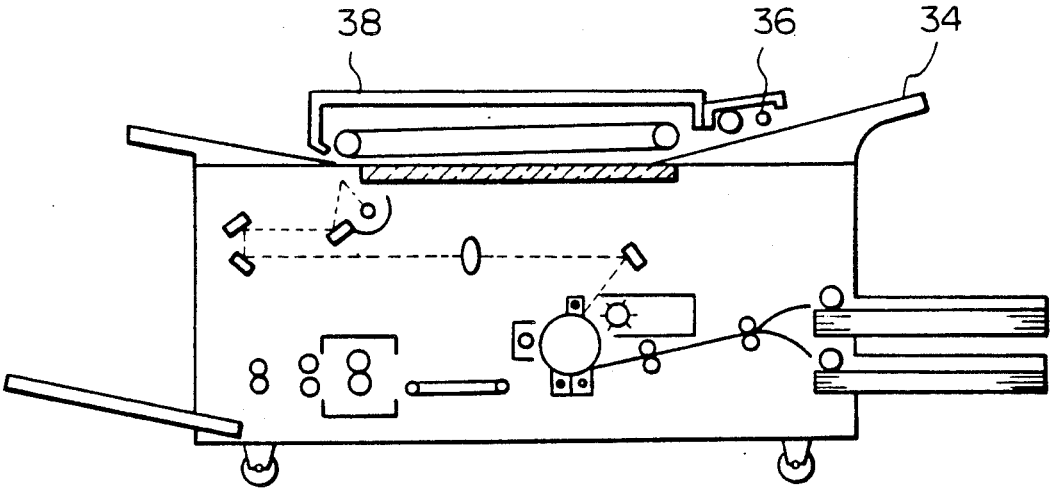
FIG. 3 is a schematic view showing various structural elements which are incorporated in the copier of FIG. 1.

An ADF 30 is associated with the copier 10 of the present invention. The ADF 30 includes an ADF controller 32, a document sensor 36 responsive to documents which are loaded on a document feed table 34 (FIG. 3), a cover plate position sensor 40 responsive to the position of a cover plate 38 which is openably hinged to the body of the copier 10 (see FIG. 3), and an ADF load 42 for driving documents which are loaded on the document feed table 34. The document sensor 36, cover plate position sensor 40 and ADF load 42 may be implemented by an optical switch, a limit switch, and a motor, respectively.

The copier controller 12 is provided with three different kinds of flags, i.e., a cover plate mode flag, a flag $T_1$ and a flag $T_2$, and two different kinds of timers, i. e. a 2-second timer and a 100-millisecond timer. The cover plate mode flag is set when a copying operation is effected in the cover plate mode. The flag $T_1$ is set when the 2-second timer expires while the an ADF open/-close switch is in an ON state. An arrangement is made such that the LCD 24 on the operation board 26 is turned ON when the flag $T_1$ is set as stated, thereby alerting a person to a document left unremoved on the glass platen. The flag $T_2$ is set when the 100-millisecond timer expires while the ADF open/close switch is in an ON state. When this flag $T_2$ is set, the buzzer 8 is caused to sound for 100 milliseconds to notify a person of the presence of a document on the glass platen. The cover plate mode flag, flag $T_1$, flag $T_2$, 2-second timer and 100-millisecond timer are reset when the cover plate 38 is opened after a cover plate mode operation, i.e., when the ADF open/close switch is turned OFF.

A specific operation of the copier 10 in accordance with the present invention will be described with reference to FIGS. 4A, 4B, 5A and 5B.

Figure 4A:
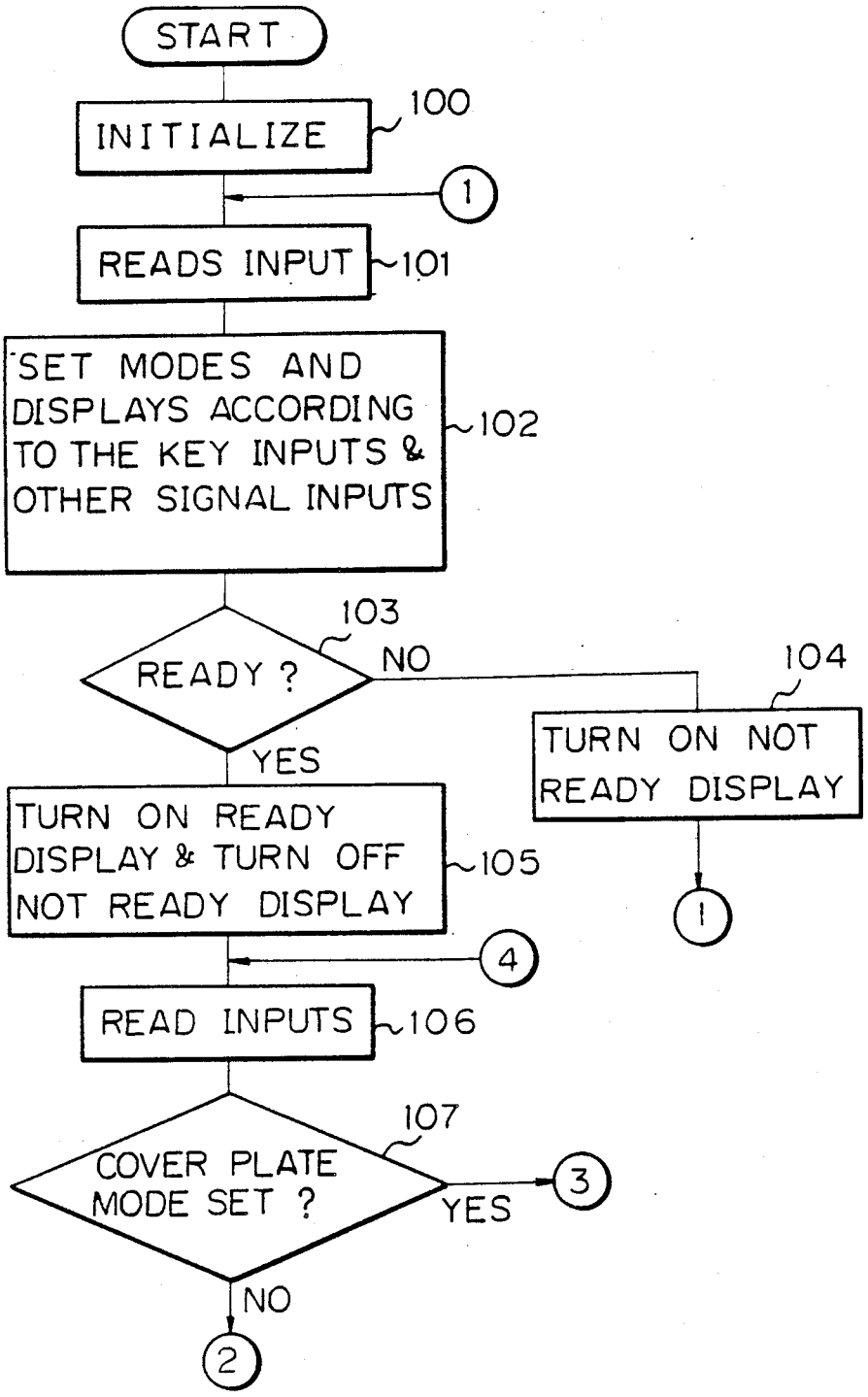
Figure 4B:
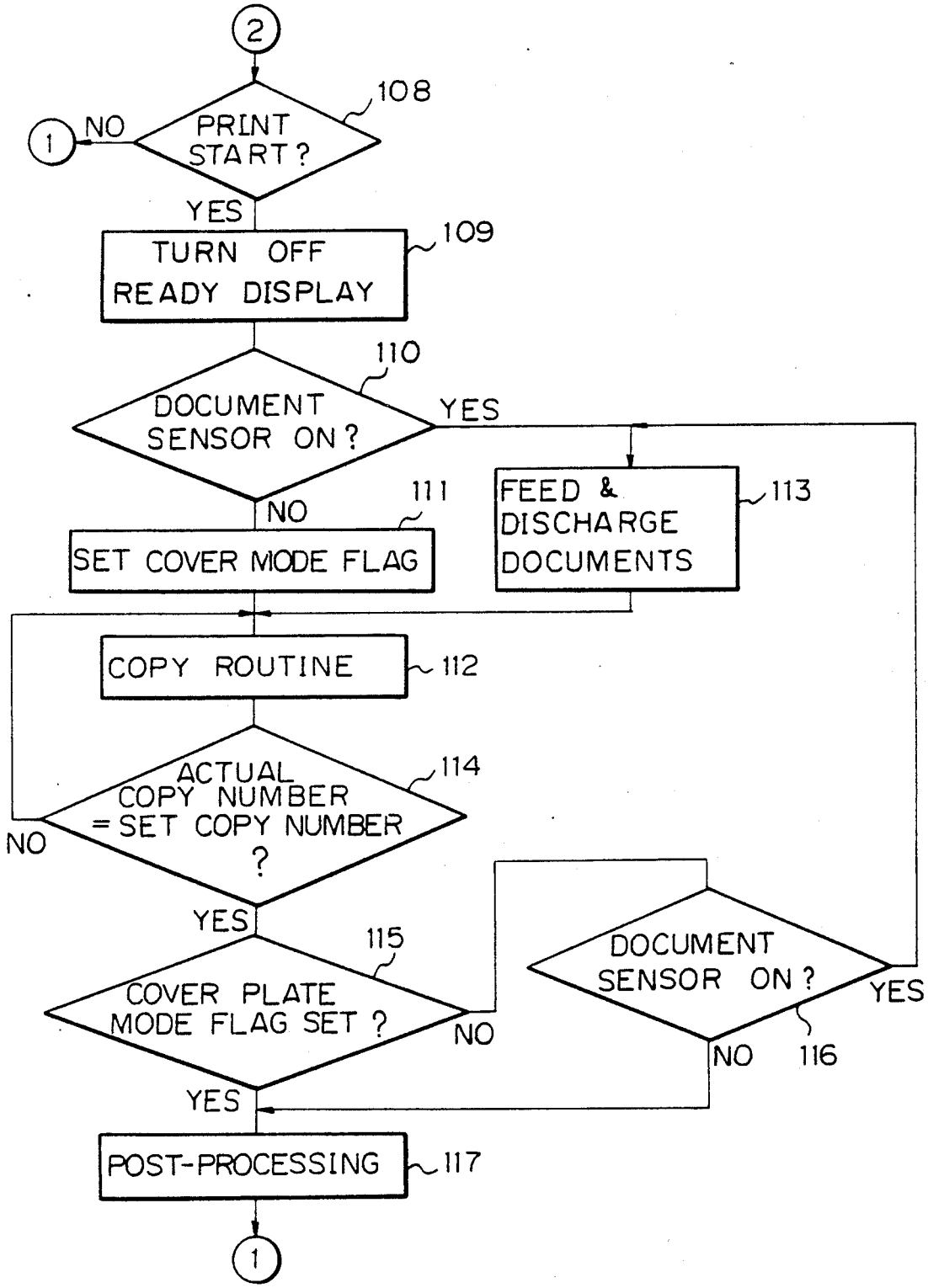

Steps 100 to 117 shown in FIGS. 4A and 4B are representative of an ordinary copy mode, or cover plate mode, in which a document is laid on the glass platen and copied with the cover plate 38 being closed, and the ADF mode. On the other hand, steps 118 and onward shown in FIGS. 5A and 5B demonstrate a procedure which is executed when a document is inadvertently left on the glass platen after a cover plate mode operation.

When a power switch (not shown) of the copier 10 is closed, the copier 10 is initialized by locating the optics at a ×1 magnification position, conditioning operation displays and indicators to their basic mode, etc. (step 100). When a person enters desired operation modes on the keys 20, the operation controller 18 reads the key inputs and sets up modes and displays as instructed thereby (steps 101 and 102). If the copier 10 is ready to operate, a READY display is turned on and a NOT READY display is turned off. If the copier 10 is not ready to operate, an INHIBIT display command is delivered (steps 103 to 105). Subsequently, the copier controller 12 reads input signals which are individually associated with the key inputs and fed from the operation controller 18 (step 106). This is followed by determining whether or not the cover plate mode flag stored in a built-in register has been set (step 107). As previously stated, the cover mode flag is set when a copy is produced in the cover plate mode and cleared when the cover plate 38 is opened to turn off the ADF open/-close switch. In the initialized condition immediately after the turn-on of the power switch, the cover plate flag remains cleared (the answer of the step 107 being "NO").

As the operator turns on a print start switch of the copier 10, a READY display OFF command is produced to turn OFF the READY display (steps 108 and 109). Then, whether or not the document sensor 36 is ON is determined (step 110). If the document sensor 36 is not ON, i.e., if the cover plate mode is selected, a predetermined copying procedure is repeated after the cover plate mode flag has been set, until the number of copies entered on the operation board 26 is reached (steps 111, 112 an 114). Conversely, if the document sensor 36 is ON, meaning that the ADF mode has been selected, document feed and discharge commands are fed to the ADF load 42 (step 113) so that a copying operation is repetitively executed until a desired number of copies are produced. In the ADF mode, as the desired number of copies are produced, the copying procedure is repeated until the document sensor 36 becomes OFF. When the copying procedure with all the documents loaded is completed, the program returns to the step 101 after post-processing including the removal of copies has been performed.

Figure 5A:
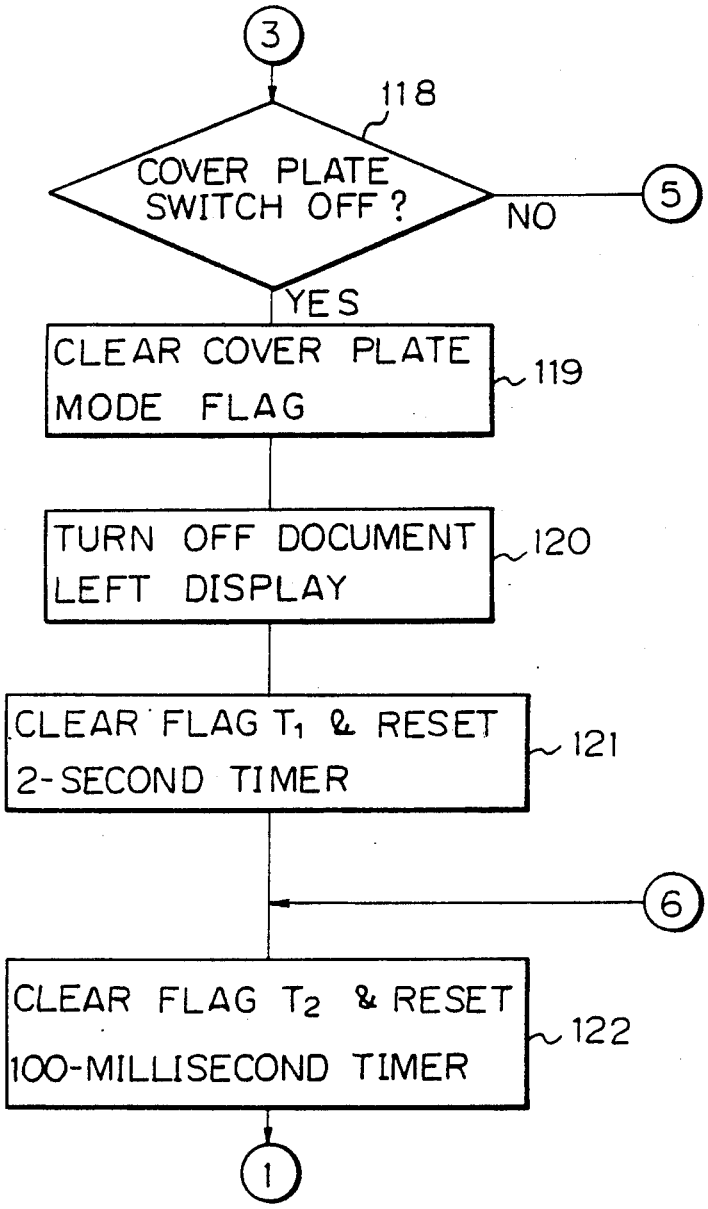
Figures 1, 5B:
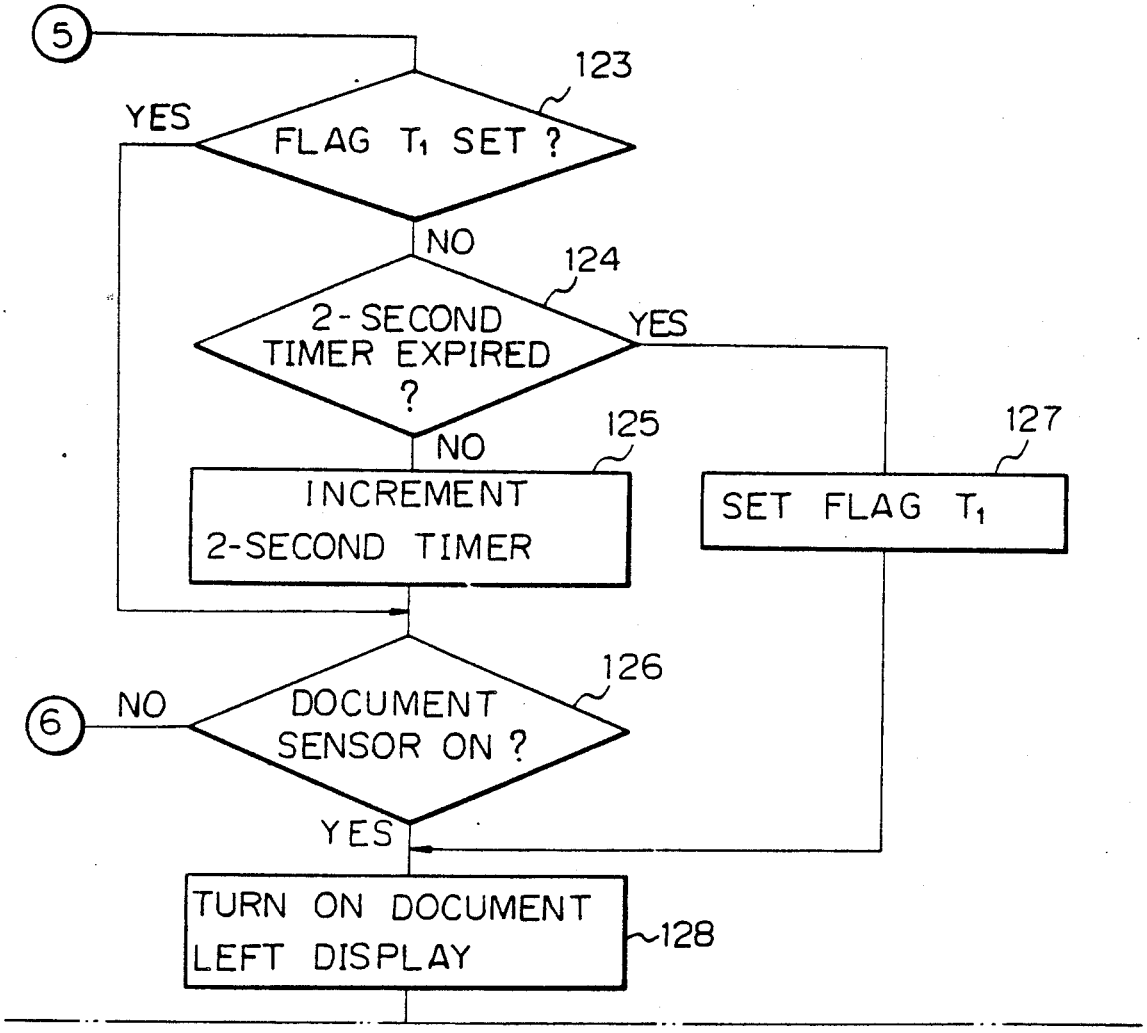
Figures 2, 5B:
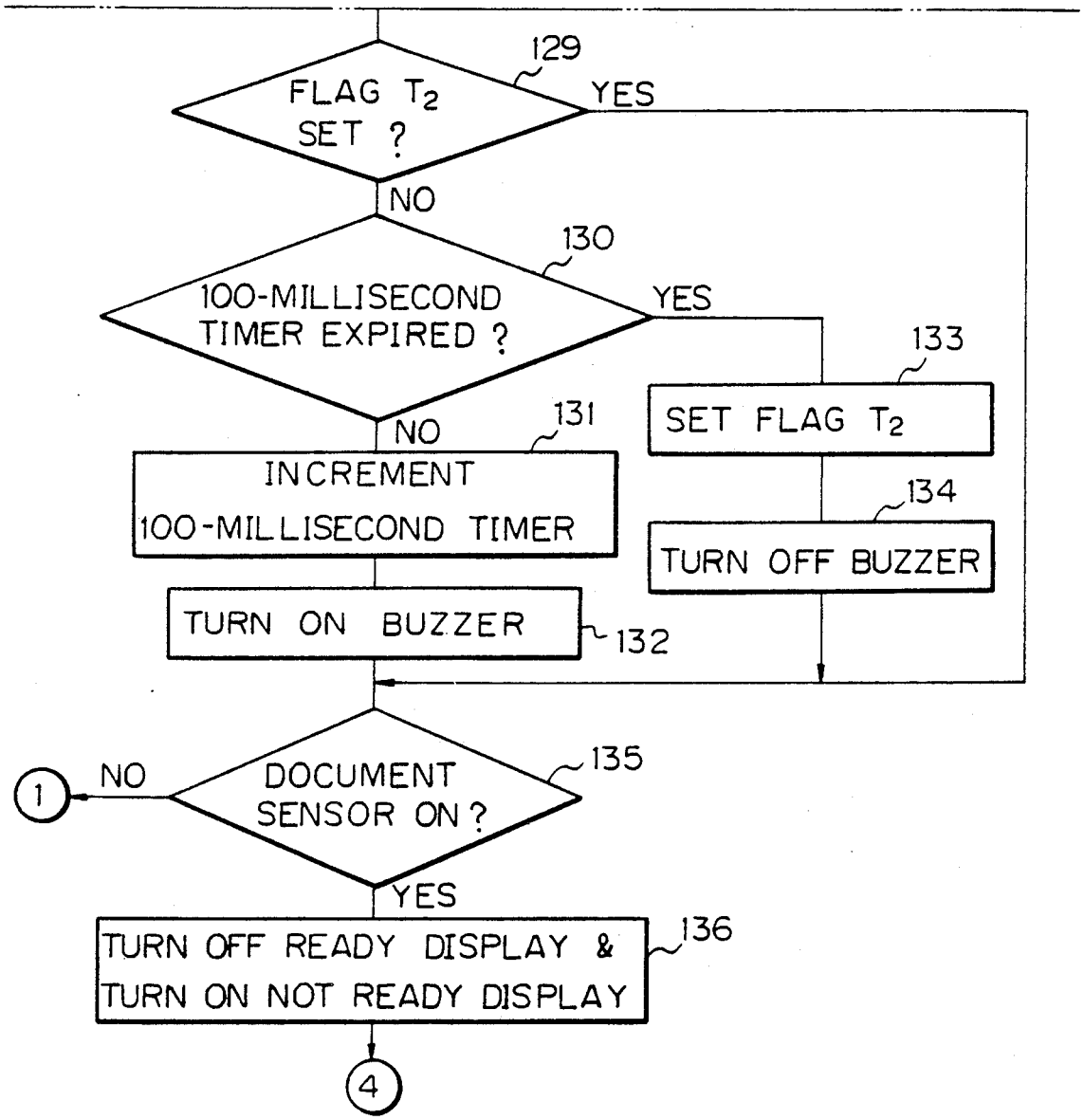

If the cover plate mode flag is set as decided at in the step 107, i.e., after a cover plate mode operation, the program advances to steps 118 and onward shown in FIGS. 5A and 5B. In the step 118, whether or not the cover plate position switch 40 is OFF is determined. If it is OFF, meaning that the a document has been removed after a cover plate mode operation by opening the cover plate 38, the cover plate mode flag is cleared and a command for turning OFF a DOCUMENT LEFT display is produced (steps 119 and 120). Subsequently, after the flag $T_1$ and 2-second timer have been reset (step 121) and then the flag $T_2$ and 1-millisecond timer have been reset (step 122), the program returns to the step 101. If the cover plate position switch 40 is ON (the answer of the step 118 being "NO"), it shows that the cover plate 38 has not been opened after a cover plate mode operation, i.e., a document is left unremoved on the glass platen.

In the above condition, whether or not the flag $T_1$ has been set is determined and, if it has been set (the answer of a step 123 being "YES"), the program advances to a step 126. If the flag $T_1$ has not been set (the answer of the step 123 being "NO"), the 2-second timer is started (step 124) and, when it expires, the flag $T_1$ is set (step 127). In a step 126, whether or not the document sensor 36 is ON is determined. If it is not ON, meaning that no documents are loaded on the document feed table 34, the operation returns to the step 122. If the document sensor 36 is ON as determined by the step 126 or if the flag $T_1$ is set as determined by the step 123, i.e., if a cover plate mode operation has been completed, the DOCUMENT LEFT display is turned ON upon the lapse of two seconds to alert the operator to the document which is left on the glass platen (step 128).

Afterwards, whether or not the flag $T_2$ is set is determined (step 129) and, if it not set, the 100-millisecond timer is started (step 130) so that the the buzzer 28 is energized for 100 milliseconds to notify the operator of the presence of a document on the glass platen (steps 131 and 132). Upon the expiration of the 100-millisecond timer, the flag $T_2$ is set while, at the same time, the buzzer 28 is turned OFF (steps 133 and 134). When the flag $T_2$ is set and the document sensor 36 is ON (the answer of a step 135 being "YES"), i.e., when the operator does not notice the document being left on the glass platen, the READY display of the LCD display 24 is turned OFF and, instead, the NOT READY display is turned ON AND the copier 10 is controlled to inhibit a copying operation (step 136).

If the document sensor 36 is OFF as decided in the step 135, meaning that all the documents have been removed from the document feed table 34, the program returns to the step 101. Once the copying operation is inhibited in the step 136, no copies are producible unless the cover plate position switch 40 is turned OFF to remove the document from the glass platen. In this case, a copying operation may be executed even if the document sensor 36 is ON.

In summary, it will be seen that a copier in accordance with the present invention allows an ADF mode operation to follow a cover plate mode operation only after a document copied in the cover plate mode has been removed from a glass platen. This prevents an occurrence that the document left on the glass platen jams the copier and is thereby damaged itself.

Various modifications will become possible for those skilled in the art after receiving the teachings of the present disclosure without departing from the scope thereof. For example, the buzzer 28 for producing a 100-millisecond alarm as shown and described may be replaced with a speech.

What is claimed is:

1. A copier selectively operable in a cover plate mode in which an original document is laid on a glass platen of a body of said copier and a cover plate openably mounted on said body is closed to copy said document and an automatic document feeder (ADF) mode in which documents loaded on a document feed table of said copier are fed automatically one by one to between said cover plate being closed and said glass platen, said copier comprising:

cover plate position sensor means for sensing an open and a closed position of said cover plate;

document sensor means for sensing original documents which are loaded on said document feed table; and control means for controlling said copier such that after a copying operation has been executed in the cover plate mode, any further copying operation is inhibited unless said cover plate is first reopened when said cover plate position sensor senses a closed position of said cover plate and said document sensor senses original documents.

2. A copier as claimed in claim 1, further comprising alarm means for, when said cover plate position sensor means senses the closed position of said cover plate after a copying operation in the cover plate mode, alerting a person to an original document which is left unremoved on said glass platen.

3. A copier as claimed in claim 2, wherein said alarm means comprises a buzzer.

4. A copier selectively operable in a cover plate mode in which an original document is laid on a glass platen of a body of said copier and a cover plate openably mounted on said body is closed to copy said document and an automatic document feeder (ADF) mode in which documents loaded on a document feed table of said copier are fed automatically one by one to between said cover plate being closed and said glass platen, said copier comprising:

cover plate position sensor means for sensing an open and a closed position of said cover plate;

document sensor means for sensing original documents which are loaded on said document feed table; and control means for controlling said copier such that after a copying operation has been executed in the cover plate mode, until said cover plate is first reopened any further copying operation is inhibited when said cover plate position sensor senses a closed position of said cover plate, said document sensor senses original documents, and the cover plate mode is not yet set.

5. A copier as claimed in claim 4, further comprising alarm means for, when said cover plate position sensor means senses the closed position of said cover plate after a copying operation in the cover plate mode, alerting a person to an original document which is left unremoved on said glass platen.

6. A copier as claimed in claim 5, wherein said alarm means comprises a buzzer.

* * * * *